US006763960B2

(12) United States Patent
Oh

(10) Patent No.: US 6,763,960 B2
(45) Date of Patent: Jul. 20, 2004

(54) CHILD RESISTANT CLOSURE AND CONTAINER

(75) Inventor: Jack S. Oh, Buena Park, CA (US)

(73) Assignee: Delta Plastics, Inc., Hot Springs, AK (US)

( * ) Notice: Subject to any disclaimer, the term of this patent is extended or adjusted under 35 U.S.C. 154(b) by 92 days.

(21) Appl. No.: 10/196,434

(22) Filed: Jul. 16, 2002

(65) Prior Publication Data

US 2004/0011791 A1 Jan. 22, 2004

(51) Int. Cl.[7] ..... B65D 55/02
(52) U.S. Cl. ..... 215/201; 220/285; 81/3.15
(58) Field of Search ..... 220/285, 793, 220/791; 81/3.15, 3.55; 215/201, 206, 209–211, 223, 230, 302–305

(56) References Cited

U.S. PATENT DOCUMENTS

| | | | | | |
|---|---|---|---|---|---|
| RE297 | E | | 9/1855 | Morris | |
| 581,153 | A | | 4/1897 | Gilfillan | |
| 812,257 | A | | 2/1906 | Booth | |
| 1,083,201 | A | | 12/1913 | Dikeman | |
| 1,101,351 | A | | 6/1914 | Suit | |
| 1,127,993 | A | | 2/1915 | Hayworth | |
| 1,140,016 | A | * | 5/1915 | Barker | 220/285 |
| 2,054,879 | A | * | 9/1936 | Darkling | 40/476 |
| 2,334,225 | A | * | 11/1943 | Socke | 220/285 |
| 2,990,076 | A | | 6/1961 | Stull | |
| 3,136,439 | A | | 6/1965 | Kuehn | |
| 3,236,126 | A | | 2/1966 | Martinmaas | |
| 3,362,556 | A | | 1/1968 | Waldrum | |
| 3,450,290 | A | | 6/1969 | Turner | |
| 3,544,338 | A | | 12/1970 | Kinney | |
| 3,572,413 | A | | 3/1971 | Livingstone | |
| 3,669,295 | A | | 6/1972 | Horvath | |
| 3,782,574 | A | | 1/1974 | Rumble | |
| 3,871,662 | A | | 3/1975 | Hepp et al. | |
| 3,888,374 | A | | 6/1975 | Smith | |
| 3,901,401 | A | | 8/1975 | Lynn et al. | |
| 3,907,145 | A | | 9/1975 | Horvath | |
| 3,926,325 | A | | 12/1975 | Benson | |
| 4,043,475 | A | | 8/1977 | Wheeler | |
| 4,087,016 | A | | 5/1978 | Towns et al. | |
| 4,098,418 | A | | 7/1978 | Fields | |
| 4,121,727 | A | | 10/1978 | Robbins et al. | |
| 4,238,033 | A | | 12/1980 | Artzt | |
| 4,347,940 | A | * | 9/1982 | Boik et al. | 215/253 |
| 4,353,462 | A | | 10/1982 | Polaneczky | |
| 4,353,483 | A | | 10/1982 | Pehr | |
| 4,393,976 | A | | 7/1983 | Maguire | |
| 4,397,397 | A | | 8/1983 | Herr | |
| 4,406,376 | A | | 9/1983 | Berghahn | |
| 4,444,326 | A | | 4/1984 | Musel | |
| 4,463,867 | A | | 8/1984 | Nagel | |
| 4,482,668 | A | | 11/1984 | Leland et al. | |

(List continued on next page.)

*Primary Examiner*—Lien Ngo
(74) *Attorney, Agent, or Firm*—Wood, Herron & Evans, LLP

(57) ABSTRACT

A closure and container combination provide a child resistant package. The closure has a top wall and a skirt depending downwardly from a peripheral edge of the top wall. The container has a bottom, a cylindrical sidewall extending upwardly from the bottom and an open top. An annular flange projects outwardly from the outer surface of the cylindrical sidewall of the container proximate the top of the container. This annular flange has a flexible tab and is positioned below the skirt when the closure and container are mated together. To remove the closure from the container, the flexible tab is pushed upwardly against the skirt thereby lifting the closure off of the container. The flexible tab prevents undesired access through the annular flange and provides leverage to aid removal of the closure. In addition, a child is inhibited by the inflexible flange from using his or her teeth or fingernail to pry open the closure from the container.

23 Claims, 2 Drawing Sheets

U.S. PATENT DOCUMENTS 4,496,066 A 1/1985 Bullock, III
4,516,683 A 5/1985 Delia
4,526,281 A 7/1985 Herr
4,550,841 A 11/1985 Sandhaus
4,576,296 A 3/1986 Lecinski
4,579,238 A 4/1986 Herr
4,694,968 A 9/1987 Proctor et al.
4,775,062 A 10/1988 Carle et al.
4,782,964 A 11/1988 Poore et al.
4,821,898 A 4/1989 Smalley
4,848,615 A 7/1989 Friedrich
5,040,691 A 8/1991 Hayes et al.
5,097,974 A 3/1992 Rozenberg
5,143,235 A 9/1992 Repp
5,161,706 A 11/1992 Weinstein
5,180,072 A 1/1993 Oehlert
5,292,017 A 3/1994 Reifers
5,312,010 A 5/1994 Johnson
5,402,900 A 4/1995 Glynn
5,603,421 A 2/1997 Opresco
5,636,756 A 6/1997 Johnson
5,702,013 A 12/1997 Freed
5,722,546 A 3/1998 Briere
5,899,348 A 5/1999 Konefal et al.
5,938,054 A 8/1999 Loader
6,079,579 A 6/2000 De Cuyper
6,161,711 A 12/2000 Miceli et al.
6,644,492 B1 * 11/2003 Mitchell ..... 220/285

* cited by examiner

CHILD RESISTANT CLOSURE AND CONTAINER

BACKGROUND OF THE INVENTION

The present invention relates generally to the field of child resistant closures, and more particularly, is directed to a reusable child resistant closure and container combination.

The closure industry has been directed by governmental agencies and others to provide for adequate safety of children by designing and manufacturing closures of a type that will discourage access to container contents which may prove harmful to children. Recent government regulations promulgated for the safety of children and other consumers have increased industry efforts to design childproof closures which are simple in operation, inexpensive in production and which can be easily affixed during assembly line processing of filled containers in a variety of industries. Such industries include, among others, the pharmaceutical, petroleum, cosmetic, household, industrial cleaner, automotive and paint industries.

Numerous container closures with child resistant features have been developed and which have been designed particularly to meet or surpass the applicable Federal Regulations. Considerable time, effort and costs have been expended in the packaging and closure industries and great strides have been made with numerous acceptable designs being developed and manufactured. These prior art closures have been tested and approved in accordance with established criteria and literally millions of such closures have been manufactured and used to date. Most of the existing, approved, child resistant closures suffer from a common drawback, that is, they are all relatively more costly in manufacture and use than the already existing closures which are not particularly designed as child resistant. In the case of certain medicines and industrial products wherein repeated use is contemplated, the need exists for a simple, inexpensive, child resistant closure which does not increase packaging costs.

SUMMARY OF THE INVENTION

This invention overcomes the foregoing and other shortcomings and drawbacks of child resistant closures and containers heretofore known. While the invention will be described in connection with certain embodiments, it will be understood that the invention is not limited to these embodiments. On the contrary, the invention includes all alternatives, modifications and equivalents as may be included within the spirit and scope of the claimed invention.

In one embodiment, the invention includes a cap or closure adapted to fit over an open top of a nestable jar or container. The cap has a generally planar top wall and outer rim surrounding the top wall. The outer rim includes an inner ridge extending upwardly from the top wall of the cap, a ledge, and an outer skirt depending downwardly from a peripheral edge of the ledge. The peripheral outside surface of the top wall of the cap near the juncture with the ridge is a continuous snap bead extending around the perimeter of the top wall.

The container has a bottom, a cylindrical sidewall extending upwardly from the bottom and an open mouth defined by an upper edge of the sidewall. The cylindrical sidewall has an inner surface which is smooth except for an inwardly directed continuous lip near the upper edge thereof. This continuous lip surrounds the inner surface of the container's sidewall and engages the continuous snap bead on the outside of the top wall of the closure when the closure is snapped over the mouth of the jar.

In addition, the container has an annular flange projecting outwardly from the outer surface of the cylindrical sidewall of the container proximate the mouth of the container beneath the upper edge. This annular flange has a flexible tab created by two spaced slits in the annular flange extending radially outwardly from the cylindrical sidewall of the container.

In operation, to remove the cap covering the open mouth of the container, the flexible tab is pushed upwardly against the skirt of the cap, causing the cap to snap off of the container. The flexible tab provides leverage to aid removal of the cap. In addition, this design reduces the possibility that a child may use his or her teeth or fingernail to pry the skirt upwardly and open the cap. To snap the cap over the open mouth of the container and thereby secure the closure to the container, the continuous snap bead on the outer surface of the inner wall of the cap is snapped over the continuous lip on the inner surface of the cylindrical sidewall of the container. With the cap snapped in place over the mouth of the container, the continuous annular bead of the cap is located underneath the continuous bead on the container sidewall and provides a seal on the inside surface of the container sidewall.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
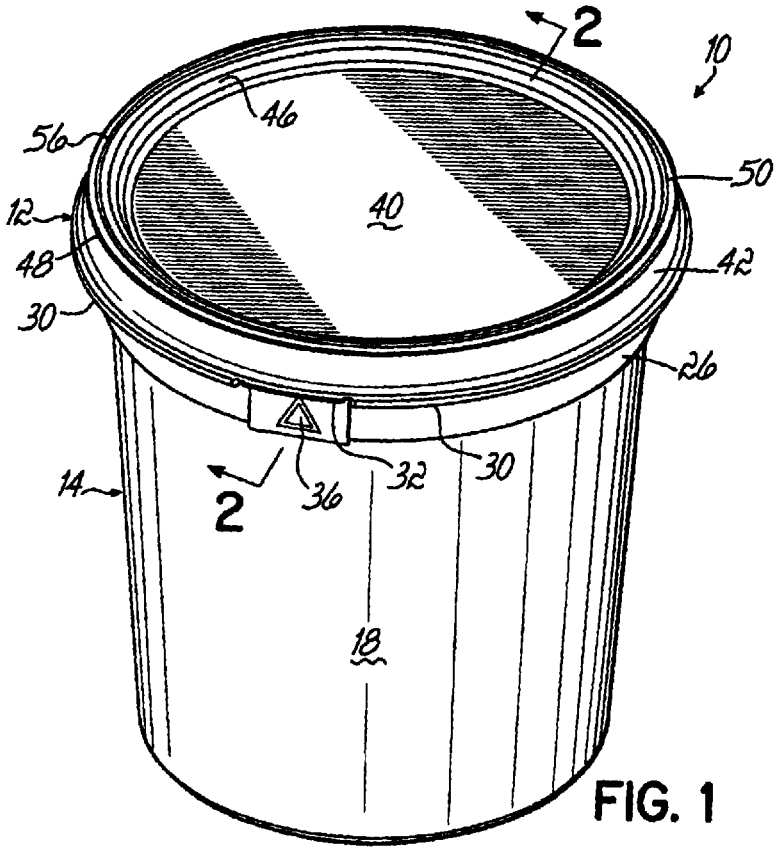
FIG. 1 is a perspective view of one embodiment of a child resistant closure and container according to this invention.
Figure 2:
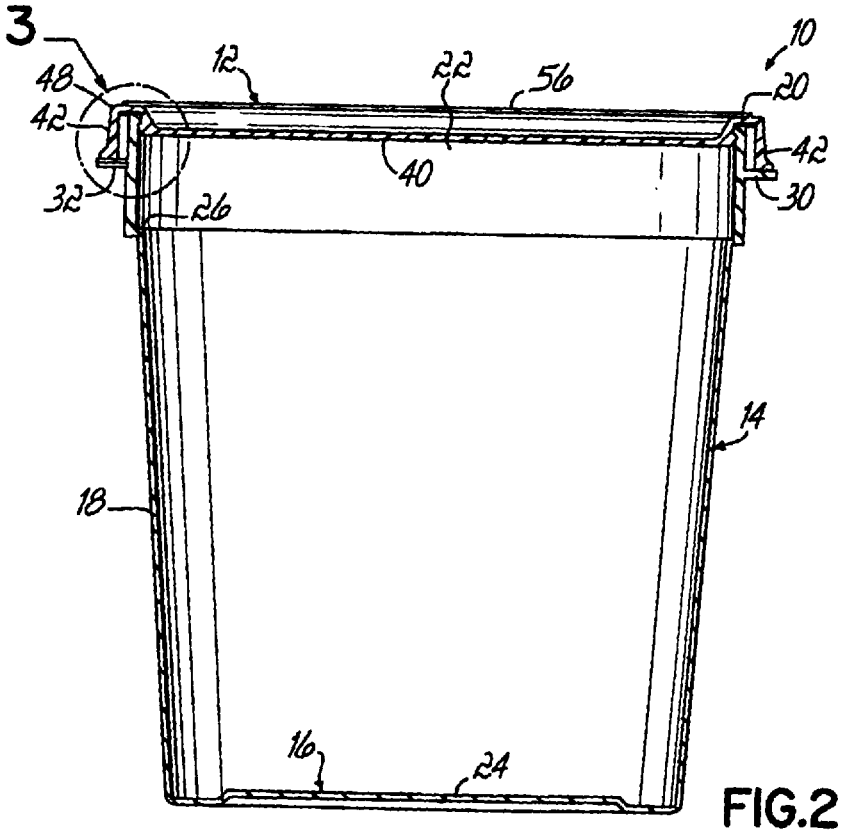
FIG. 2 is a cross-sectional view taken along line 2—2 of the closure and container of FIG. 1.

Referring to FIGS. 1 and 2, one embodiment of the child resistant package 10, according to this invention, is shown. The child resistant package 10 includes a closure or cap 12 adapted to mate with a jar or container 14. The container 14, according to one embodiment of this invention, has a generally circular bottom 16 and a cylindrical sidewall 18 extending upwardly from the bottom 16. The container 14 may be manufactured of a thermoplastic material or any other suitable container material. An upper edge 20 of the container sidewall defines a normally open mouth 22 of the container 14. The bottom 16 of the container 14 may have a central depression 24, as is well known in the art. Additionally, an inner surface of the sidewall 18 of the container 14 is generally smooth except for an annular outward jog 26 spaced from the upper edge 20. Additionally, an inwardly directed continuous annular snap lip 28 is closely adjacent the upper edge 20 of the sidewall 18.

As shown in FIGS. 1–5, a flange 30 projects generally perpendicularly outwardly from the sidewall 18 and extends substantially entirely around the container 14 proximate the upper edge 20 of the container 14. The flange 30 is spaced from the upper edge 20 approximately 0.317", in one embodiment, and the sidewall 18 of the container 14 has a 4° taper from the bottom 16 to the jog 26. The overall height of the container 14 is approximately 4" and the sidewall 18 thickness is approximately 0.30". The diameter of the open mouth 22 of the container 14 at the upper edge 20 is approximately 3.380" and the outer circumference of the flange 30 is approximately 3.690".

The annular flange 30 extending outwardly from the sidewall 18 of the container 14 includes a flexible tab portion 32 which likewise projects generally perpendicularly outward from the sidewall 18 and is circumferentially aligned and generally contiguous with the flange 30 proximate the upper edge 20 of the sidewall 18. A pair of slits 34, which may be V-shaped, border the flexible tab portion 32 adjacent the remainder of the flange 30. The flexible tab portion 32 is employed by a user in removal of the closure 12 from the container 14, as will be described herein below. As such, indicia 36 such as an arrow or the like, is formed on the outside surface of the container sidewall 18, indicating the position of the flexible tab portion 32. In one embodiment, the thickness of the flexible tab portion 32 is less than the remainder of the flange 30.

Figure 5:
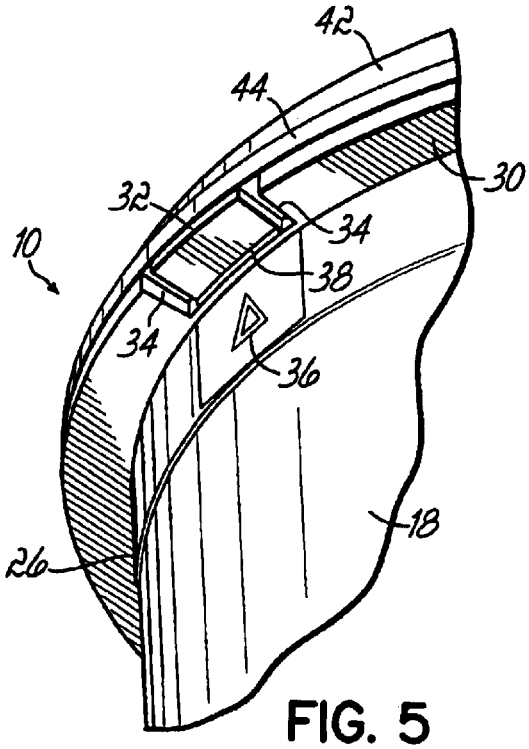
FIG. 5 is a perspective view similar to FIG. 4 with the closure being lifted off of the container.

Referring to FIG. 5, a generally linear hinge 38, which may be a living hinge with a depression (not shown), is at the root of the flexible tab portion 32 to flexibly and hingedly couple the tab 32 to the sidewall 18 of the container 14. The hinge 38 allows pivotal movement of the flexible tab portion 32 relative to the container sidewall 18; whereas, the remainder of the flange 30 is generally inflexible and not capable of movement relative to the sidewall 18 under normal user-applied forces in standard operating conditions for the child resistant package 10.

The closure 12 in one embodiment includes a generally circular top wall 40 and a downwardly depending skirt 42 having an enlarged terminal edge 44 that is proximate and may be in contact with the flange 30. As is apparent primarily from FIG. 3, the outer circumference of the flange 30 is greater than that of the terminal edge 44 of the skirt 42, so that when the closure 12 and container 14 are mated together, a user or child does not have direct access to the skirt 42 other than through the flexible tab portion 32.

The top wall 40 of the closure 12 is connected to an annular ridge 46 which projects at an angle generally upwardly and outwardly from the top wall 40. The ridge 46 is connected to an upper ledge 48, which in turn, is connected to the downwardly depending skirt 42. The ridge 46 and ledge 48 in combination define an outer rim 50 of the closure 12 and likewise an annular space 52 between the skirt 42 and an outer perimeter of the top wall 40 into which the upper edge 20 of the sidewall 18 is positioned when the container 14 and closure 12 are mated together.

A circumferential snap bead 54 projects outwardly on the closure 12 proximate the intersection of the ridge 46 and the top wall 40. The snap bead 54 on the closure 12 cooperates with the circumferential snap lip 28 on the inner surface of the sidewall 18 to form a snap fit between the closure 12 and container 14. Advantageously, the snap fit is accomplished on the inside surface of the container 14 which provides for a more sterile environment as well as benefits during the manufacturing process of the components.

The closure 12 is mated with the container 14 by positioning the top wall 40 in alignment with the open mouth 22 of the container 14 and pressing the closure 12 downwardly so that the bead 54 snaps into place below the lip 28 on the container 14, thereby mating the container 14 and closure 12 together. Removal of the closure 12 is accomplished by the user pressing upwardly in the direction of arrow A (FIG. 4) on the flexible tab portion 32 of the flange 30. Upward pressure on the flexible tab portion 32 in turn pushes upwardly on the terminal edge 44 of the skirt 42, thereby removing the closure 12 from the container 14. Subsequent installation and removal of the closure 12 to the container 14 is readily available, as is common practice.

The flexible tab 32 provides leverage to assist in removal of the closure 12 from the container 14. Additionally, the flange 30 reduces the possibility that a child may use his or her teeth, fingernail or other object to pry the skirt 42 upwardly and remove the closure 12 from the container 14 without utilizing the flexible tab portion 32. Upward pressure on the flange 30 and regions other than the flexible tab portion 32 does not result in removal of the closure 12 because the user does not gain the benefit of the leverage afforded by the flexible tab. Moreover, the slope of the ridge 46, forming an obtuse angle with the top wall and configuration of the rim 50, inhibits a child from biting the rim 50 to pull the closure 12 off of the container 14.

Figure 3:
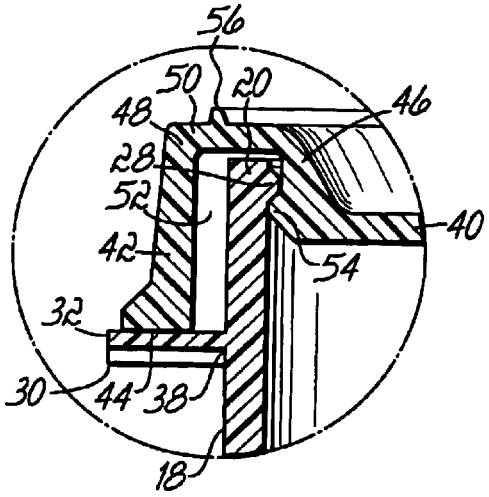
FIG. 3 is an enlarged view of the encircled area 3 of FIG. 2.
Figure 4:
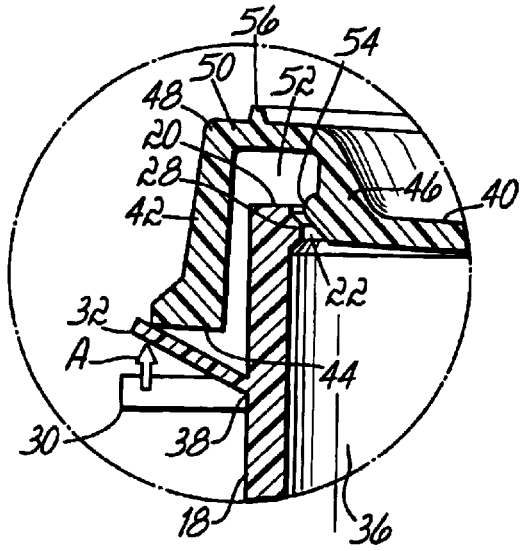
FIG. 4 is a perspective view of a tab in a flange on the container.

As such, a child resistant package 10, according to this invention, avoids the need for a unique rotational alignment of the closure 12 relative to the container 14, as in many prior designs. Likewise, opening the package by an unauthorized user such as a child, is inhibited by the geometry of the closure 12 and the inflexible portions of the flange 30. Prying or forcing the closure 12 off of the container 14 is generally not available due to the inaccessible arrangement of the skirt 42 relative to the flange 30, as shown in FIGS. 2 and 3.

Multiple containers 14, according to this invention, may be nested one inside the other, and likewise, multiple closures 12 may be nested one atop the other, and an annular bead 56 extending upwardly from the ledge 48 assists in alignment during stacking of multiple closures 12 upon one another.

While the present invention has been illustrated by a description of various embodiments and while these embodiments have been described in considerable detail, it is not the intention to restrict or in any way limit the scope of the appended claims to such detail. Additional advantages and modifications will readily appear to those skilled in the art. It should be readily understood that other configurations, shapes, materials and designs of a child resistant package other than those shown and described herein, are readily available within the scope of this invention. The invention in its broader aspects is therefore not limited to the specific details, representative apparatus and method, and illustrative example shown and described. Accordingly, departures may be made from such details without departing from the spirit or scope of the general inventive concept.

Having described the invention, what is claimed is:

1. A child resistant package comprising:

a container including a bottom wall and a sidewall extending upwardly from the bottom wall, an upper edge of the sidewall defining a mouth of the container;

a flange projecting generally perpendicularly outward from the sidewall and extending substantially entirely around the container proximate the upper edge thereof and generally parallel to the bottom wall;

a flexible tab portion of the flange projecting outwardly from the sidewall and being circumferentially aligned and generally contiguous with the flange proximate the upper edge of the sidewall; and a closure including a top wall and a downwardly depending skirt;

wherein the closure is adapted to mate with the container and releasably engage the upper edge of the sidewall to thereby close the mouth of the container;

wherein when the closure is mated with the container the skirt is juxtaposed to the flange on the container such that releasing the closure from the container commences initially with upward force on the tab portion to deflect the tab portion upwardly against the skirt and thereby release the closure from the container.

2. The package of claim 1 further comprising:

a living hinge coupling the tab portion to the sidewall of the container.

3. The package of claim 2 wherein the sidewall is generally arcuate and the living hinge is generally linear.

4. The package of claim 1 further comprising:

a pair of slits in the flange bordering the tab portion of the flange.

5. The package of claim 1 wherein the flange is generally inflexible, with the exception of the tab portion, so that a user can not dislodge the closure from the container with upwardly directed force thereon.

6. The package of claim 1 wherein the flange is in contact with the skirt when the closure and container are mated together.

7. The package of claim 1 further comprising:

a circumferential bead on the closure; and a circumferential lip on the sidewall of the container whereby the bead and the lip provide an interference snap fit there between when the closure and container are mated together.

8. The package of claim 7 wherein the bead projects outwardly on the closure and the lip is on an interior surface of the sidewall to provide a seal between the closure and the interior of the container.

9. The package of claim 1 further comprising:

an outer rim coupling the skirt to the top wall; and an annular space between the skirt and an outer perimeter of the top wall;

wherein the upper edge of the sidewall is interposed within the annular space when the closure and container are mated together.

10. The package of claim 9 wherein the outer rim further comprises:

a ridge projecting from the outer perimeter of the top wall; and a ledge projecting from the ridge and connected to the skirt.

11. The package of claim 1 wherein the closure and a cross section of the sidewall are each generally circular.

12. The package of claim 1 wherein an outer circumference of the flange is greater than an outer circumference of the skirt.

13. A child resistant package comprising:

a container including a bottom wall and a sidewall extending upwardly from the bottom wall, an upper edge of the sidewall defining a mouth of the container;

a flange projecting outwardly from the sidewall and extending substantially entirely around the container proximate the upper edge thereof;

a flexible tab portion of the flange projecting outwardly from the sidewall and being circumferentially aligned and generally contiguous with the flange proximate the upper edge of the sidewall; and a closure including a top wall and a downwardly depending skirt;

wherein the closure is adapted to mate with the container and releasably engage the upper edge of the sidewall to thereby close the mouth of the container;

wherein when the closure is mated with the container the skirt is juxtaposed to the flange on the container such that upward force on the tab portion deflects the tab portion upwardly against the skirt to thereby release the closure from the container;

wherein the flange and the associated tab portion each project generally perpendicularly from the sidewall of the container.

14. The package of claim 1 further comprising:

a rim coupling the skirt to the top wall;

wherein the rim extends at an obtuse angle from the top wall.

15. A child resistant package comprising:

a container including a generally circular bottom wall and an arcuate sidewall extending upwardly from the bottom wall, an upper edge of the sidewall defining a mouth of the container;

a flange projecting generally perpendicularly outward from the sidewall and extending substantially entirely around the container proximate the upper edge thereof and generally parallel to the bottom wall;

a flexible tab portion of the flange projecting outwardly from the sidewall and being circumferentially aligned and generally contiguous with the flange proximate the upper edge of the sidewall;

a generally linear hinge coupling the tab portion to the sidewall of the container;

a pair of slits in the flange bordering the tab portion;

a closure including a top wall and a downwardly depending skirt;

wherein the closure is adapted to mate with the container and releasably engage the upper edge of the sidewall to thereby close the mouth of the container;

wherein when the closure is mated with the container the skirt is juxtaposed to the flange on the container such that releasing the closure from the container commences initially with upward force on the tab portion to deflect the tab portion upwardly against the skirt and thereby release the closure from the container;

wherein the flange is generally inflexible, with the exception of the tab portion, so that a user can not dislodge the closure from the container with upwardly directed force thereon.

16. The package of claim 15 wherein the flange is in contact with the skirt when the closure and container are mated together.

17. The package of claim 15 further comprising:

a circumferential bead on the closure; and a circumferential lip on the sidewall of the container whereby the bead and the lip provide an interference snap fit there between when the closure and container are mated together.

18. The package of claim 17 wherein the bead projects outwardly on the closure and the lip is on an interior surface of the sidewall to provide a seal between the closure and the interior of the container.

19. The package of claim 15 further comprising:

an outer rim coupling the skirt to the top wall, the outer rim projecting at an obtuse angle from the top wall; and an annular space between the skirt and an outer perimeter of the top wall;

wherein the upper edge of the sidewall is interposed within the annular space when the closure and container are mated together.

20. The package of claim 19 wherein the outer rim further comprises:

a ridge projecting from the outer perimeter of the top wall; and a ledge projecting from the ridge and connected to the skirt.

21. The package of claim 15 wherein an outer circumference of the flange is greater than an outer circumference of the skirt.

22. A child resistant package comprising:

a container including a generally circular bottom wall and an arcuate sidewall extending upwardly from the bottom wall, an upper edge of the sidewall defining a mouth of the container;

a flange projecting outwardly from the sidewall and extending substantially entirely around the container proximate the upper edge thereof;

a flexible tab portion of the flange projecting outwardly from the sidewall and being circumferentially aligned and generally contiguous with the flange proximate the upper edge of the sidewall;

a generally linear hinge coupling the tab portion to the sidewall of the container;

a pair of slits in the flange bordering the tab portion;

a closure including a top wall and a downwardly depending skirt;

wherein the closure is adapted to mate with the container and releasably engage the upper edge of the sidewall to thereby close the mouth of the container; wherein when the closure is mated with the container the skirt is juxtaposed to the flange on the container such that upward force on the tab portion deflects the tab portion upwardly against the skirt to thereby release the closure from the container;

wherein the flange is generally inflexible, with the exception of the tab portion, so that a user can not dislodge the closure from the container with upwardly directed force thereon;

wherein the flange and the associated tab portion each project generally perpendicularly from the sidewall of the container.

23. A child resistant package comprising:

a container including a generally circular bottom wall and an arcuate sidewall extending upwardly from the bottom wall, an upper edge of the sidewall defining a mouth of the container;

a flange projecting generally perpendicularly outward from the sidewall and extending substantially entirely around the container proximate the upper edge thereof and generally parallel to the bottom wall;

a flexible tab portion of the flange projecting generally perpendicularly outward from the sidewall and being circumferentially aligned and generally contiguous with the flange proximate the upper edge of the sidewall;

a generally linear living hinge coupling the tab portion to the sidewall of the container;

a pair of slits in the flange bordering the tab portion;

a closure including a top wall and a downwardly depending skirt, an outer circumference of the flange being greater than an outer circumference of the skirt;

wherein the closure is adapted to mate with the container and releasably engage the upper edge of the sidewall to thereby close the mouth of the container;

a circumferential bead projecting outwardly on the closure;

a circumferential lip on an interior surface of the sidewall of the container;

whereby the bead and the lip provide an interference snap fit there between when the closure and container are mated together;

a ridge projecting at an obtuse angle from the outer perimeter of the top wall;

a ledge projecting from the ridge and connected to the skirt;

an annular space between the skirt and an outer perimeter of the top wall;

wherein the upper edge of the sidewall is interposed within the annular space when the closure and container are mated together;

wherein when the closure is mated with the container the skirt is juxtaposed to the flange on the container such that releasing the closure from the container commences initially with upward force on the tab portion to deflect the tab portion upwardly against the skirt and thereby release the closure from the container;

wherein the flange is generally inflexible, with the exception of the tab portion, so that a user can not dislodge the closure from the container with upwardly directed force thereon.

* * * * *